US006686888B1

(12) United States Patent
Wendt et al.

(10) Patent No.: US 6,686,888 B1
(45) Date of Patent: Feb. 3, 2004

(54) VEHICLE ANTENNA

(75) Inventors: Dirk Wendt, Dettingen am Erms (DE); Martin Kuhn, Stuttgart (DE)

(73) Assignee: Hirschmann Electronics GmbH & Co. Kg., Neckartenzlingen (DE)

( * ) Notice: Subject to any disclaimer, the term of this patent is extended or adjusted under 35 U.S.C. 154(b) by 0 days.

(21) Appl. No.: 10/088,557

(22) PCT Filed: Nov. 20, 2000

(86) PCT No.: PCT/EP00/10383

§ 371 (c)(1),
(2), (4) Date: Mar. 19, 2002

(87) PCT Pub. No.: WO01/48865

PCT Pub. Date: Jul. 5, 2001

(30) Foreign Application Priority Data

Dec. 23, 1999 (DE) ..... 199 62 736

(51) Int. Cl.[7] ..... H01Q 1/32
(52) U.S. Cl. ..... 343/713; 343/711
(58) Field of Search ..... 343/713, 846, 343/700 MS, 848, 711, 712

(56) References Cited

U.S. PATENT DOCUMENTS 5,457,467 A * 10/1995 Schenkyr et al. ..... 343/713
5,959,586 A * 9/1999 Benham et al. ..... 343/713
6,097,345 A * 8/2000 Walton ..... 343/769
6,351,242 B1 * 2/2002 Hesker ..... 343/713
6,433,748 B1 * 8/2002 Ekelund ..... 343/713

FOREIGN PATENT DOCUMENTS

| | | |
|---|---|---|
| DE | 89 13 811.2 | 2/1990 |
| DE | 40 00 381 A 1 | 7/1991 |
| DE | 71 27 020.7 | 2/1992 |
| DE | 41 16 232 A1 | 11/1992 |
| DE | 44 03 643 A1 | 8/1995 |
| DE | 44 43 596 A1 | 6/1996 |
| DE | 196 29 115 A 1 | 1/1998 |
| DE | 298 18 430 U1 | 6/1999 |
| DE | 198 30 811 A1 | 9/1999 |
| EP | 0 821 429 A2 | 1/1998 |
| EP | 0 899 810 A2 | 3/1999 |
| FR | 2 742 584 A 1 | 6/1997 |
| WO | WO 99/21247 | 4/1999 |

* cited by examiner

*Primary Examiner*—James Clinger
(74) *Attorney, Agent, or Firm*—Fulbright & Jaworski LLP

(57) ABSTRACT

An antenna, especially for use with mobile radios, that is mounted in an opening of a motor vehicle. The antenna includes at least one radiator with connecting line and the radiator is mounted in the opening behind a nontransparent, nonconductive covering. In one embodiment the radiator is configured as a monopole with matched balancing antennae that are strip conductors laid out on a printed circuit board attached to a ventilation structure mounted in an opening behind a covering nonconductive bumper.

29 Claims, 2 Drawing Sheets

VEHICLE ANTENNA

BACKGROUND OF THE INVENTION

1. Field of the Invention

The present invention relates to a motor vehicle antenna. More particularly, the present invention relates to a motor vehicle antenna intended for mobile radios having at least one radiator integrated in a body opening of a motor vehicle.

2. Description of the Related Technology

Certain prior art antennas are known in several versions. For example, DE 41 16 232 A1 describes an antenna which is integrated into a nonconductive motor vehicle bumper (and thus is not visible). However, as is appreciated, the antenna is greatly endangered in the event of a crash. This applies especially to such an antenna having two probes which are located in the corner areas of the bumper and which are connected to one another by a line and optionally a line coupler. As will be appreciated, the antenna is no longer serviceable due to interruption of the connecting line.

Moreover, the required minimum distance of the radiators from the metallic body which is used as a reflector in modern motor vehicles is becoming more rare because the bumpers are no longer raised for reasons of design and safety, but are located tightly against the body. The mutual distance is thus partially less than 20 mm, by which in the frequency ranges intended for mobile radios overly strong capacitive coupling is formed which essentially causes a short circuit of the antenna.

In a motor vehicle antenna known from DE 198 30 811 A1 this short distance is not possible also due to the radar housing located on the inside of the bumper.

The known bumper antennas thus cannot be used in these motor vehicles, so that their area of application is greatly limited.

In addition, to route the connecting lead into the interior of the body, an additional splash-proof opening is required, and thus the production and installation cost is increased.

A further known antenna type is disk antennas (see for example DE 44 43 596 A1) in which the radiators are integrated into the motor vehicle windows. These do not have the aforementioned disadvantages, but they are located visibly on the vehicle in an unwanted manner.

Therefore objects of the invention are to devise a motor vehicle antenna of the initially mentioned type, which is little endangered by crash damage, and is as simple and economical as possible. It is to be independent of the distance of the radiator from the body in its effectiveness, and does not require a special body penetration for the connecting lead.

These and other objects of the present invention are achieved by providing a motor vehicle antenna having at least one radiator integrated in one body opening and having one connecting lead, wherein at least one radiator is located on a nonconductive, carrier part which is covered by a separate nontransparent and nonconductive attachment part located in and separate from the body opening.

Because the antenna and the connecting lead are not components of the attachment part, the danger of damage, at least in milder collisions, is greatly reduced compared to bumper antennas. Here the attachment part acts as a screen, without additional cost, so that there is no apparent indication of the presence of a mobile radio with the associated danger of theft.

The arrangement of the radiator in the body opening in which the conductive body is therefore not used as a reflector furthermore makes the antenna completely independent of the distance of the attachment part from the radiator. The antenna is thus also suited for use in modern motor vehicles in which this distance is being increasingly reduced.

Last, but not least, in the arrangement of the motor vehicle antenna as claimed in the invention an additional body opening which must be specially sealed for routing the antenna connecting cable is not necessary, but rather shell-side cabling is economically enabled.

The attached claims give other advantageous embodiments of the present invention.

According to one feature of the invention, it is especially advantageous to use a component already present for other purposes as the attachment component (and thus save additional components). For example, according to one embodiment, the attachment part is a plastic bumper. Alternatively, according to another embodiment, the attachment part is an antibumping strip. As will be appreciated, these embodiments are advantageous in that bumpers as well as antibumping strips extend over larger areas within which the body opening can be located.

According to another feature of the invention, the radiator (s) comprise a monopole with a matched balancing antenna and the body opening is of an essentially rectangular configuration, wherein its dimensions in the radiator direction are $>1/6$ of the average wavelength ($\lambda$) and orthogonally thereto are $>\lambda/3$. Due to the balancing antenna, a connection at an additional reference potential (such as that of a metal body) can be omitted, further reducing the cost in production and installation. In addition, the execution as a matched balancing antenna and the dimensioning of the body opening results in a barrier to jacket waves on the feed line.

For installation sites with a short height, especially behind relatively narrow antibumping strips, a slot antenna is suited. Here the length of the body opening must be greater than $\lambda/2$, but its height (slot width) is short.

One embodiment of the motor vehicle antenna has a reflector located towards the motor vehicle interior. The use of a reflector is especially effective, regardless of whether it is made as a monopole or a slot antenna. This is because the reflector causes emission only to the outside, therefore in the preferred direction, and with increased power. The distance of the reflector from the radiator can have exactly the value which is optimum in terms of high frequency engineering and is not, as in bumper antennas, shortened as a compromise which adversely affects the radiation properties.

If air passage or pressure equalization is necessary (as in ventilation openings of a motor vehicle body), the configuration of the reflector is a lattice-like pattern which may be the optimum solution because it meets both requirements and is built to save material and weight.

With an antenna arrangement comprising two interconnected radiators, the pattern can be advantageously matched to the requirements of the individual case within certain limits.

For example, the directional effect can be intensified in certain angular ranges. But it is also possible to produce at least approximately an omni-directional radiation pattern by an arrangement of the two probes lengthwise on opposite sides of the motor vehicle body; which is generally desirable for receiving or transmitting in motor vehicles due to the continually changing directions of travel.

According to another aspect of the invention, a dual band antenna may be formed with minimum cost. According to this aspect, the length of the monopole, and optionally of the balancing antennas, is dimensioned for a lower frequence range. One blocking element at a time is inserted into the monopole and optionally the balancing antenna(s), for the upper frequency range, such that their length between the blocking element and the antenna terminal point (A) is matched to the upper frequency range. Notably, with this configuration, it can be designed, for example, for the D network and E network. Frequency ranges for these networks, depending on whether in Europe or the United States, are for the D network (0.88–0.96 Gigattertz ("GHz")) and for the E network D (1.71–1.99 (GHz)). Of course it is also possible to further increase the frequency range of the motor vehicle antenna by connecting additional blocking elements.

These blocking elements are made simply and feasibly as LC elements, or alternatively, they are made as line tuned circuits.

According to the invention, the monopole, and optionally the balancing antenna(s), comprise printed circuits on a circuit board. This configuration gives a structure of the motor vehicle antenna which is especially simple and economical in production and installation. The radiator and balancing antenna parts can be made very exact here. In addition, the board imparts stability to the radiator in spite of the thin conductor and moreover can be mounted much more favorably than pure antenna wires.

In addition, the LC blocking elements can be easily inserted into the printed conductors according to both mechanical and also electrical requirements, advantageously for example, in Surface Mounted Device ("SMD") technology (i.e. SMD components inserted into printed circuits).

Finally, the dielectric of the board also acts electrically so that the radiator and balancing antennas can be made smaller.

In most applications the body openings are not sealed tight or are covered by the attachment parts. In one advantageous embodiment of the invention, the circuit broads (optionally with the blocking elements) are surrounded with insulating material, preferably potting material. More preferably, it is contemplated that the entire circuit board be jacketed splash proof with insulation material. To do this it is especially simple and feasible to extrusion-coat or pot the component. In this version, it is moreover possible to create almost any outside contour and thus to optimally match the component to the shape of the installation surface.

The casting compound moreover makes it possible to impart a defined elasticity to the jacketed component or to preserve its elasticity; this is especially advantageous when these components are attached to strongly vibrating or oscillating elements, such as for example, motor vehicle parts.

The use of thermoplastic hot-melt cements as a casting compound is especially advantageous because, as a result of its short hardening time and the possibility of using an injection molding process in the low pressure range, it allows time-saving and economical production.

Moreover, as a result of cementing by the hot-melt cement, absolute tightness and moreover high strain relief of the parts routed out of the jacketing, such as for example cable jackets, are achieved. The thermoplastic hot-melt cement in cable jackets of thermoplastic, for example PVC or PE, forms a chemical compound with the latter at least on the surface, a compound which is absolutely tight and which ensures high strain relief.

Advantageously, the circuit board is attached to a non-conductive carrier part which is already present for other purposes. This ensures not only a stable arrangement, but this radiator component can be retrofitted at any time on the motor vehicle. It can of course also be integrated as original equipment on or in a plastic carrier part.

One especially suitable installation site for the antenna as claimed in the invention is the ventilation openings which are located on both sides of the trunk compartment in most passenger cars for pressure equalization when the motor vehicle doors are quickly closed. These openings are covered by the plastic bumpers and are not easily visible behind them.

In these body openings, generally louver-like ventilation flaps are mounted which are provided with tabs which can move to the outside and which open to the outside on the pressure of the motor vehicle interior and otherwise adjoin the ventilation flaps to prevent the penetration of water.

In this case it is especially advantageous to attach the components which have the monopole (and optionally the balancing antennas) to the ventilation flaps, with the understanding that the mobility of the tabs should not be hindered.

Especially simple and relatively stable mounting may be achieved by use of retaining pins, preferably having elastic projections. The retaining pins are economically produced in one piece with the ventilation flaps, for example, in a injection molding process. Preferably, the retaining pins are made integral with the carrier part (which is preferably the ventilation flaps), and more preferably the carrier part and retaining pins are an injection molding. The antenna part which has the radiator can then be locked simply onto the pertinent ventilation flap for installation.

If in the individual case, the height of the cover is not great enough to cover the radiator which is made as a monopole, its height can be shorted in the conventional manner by a roof capacitance and it can be adapted to circumstances.

BRIEF DESCRIPTION OF THE DRAWINGS

The invention is explained below in the figures using the embodiment made as a mobile radio antenna located on the ventilation flaps.

DETAILED DESCRIPTION OF THE INVENTION

Figure 1:
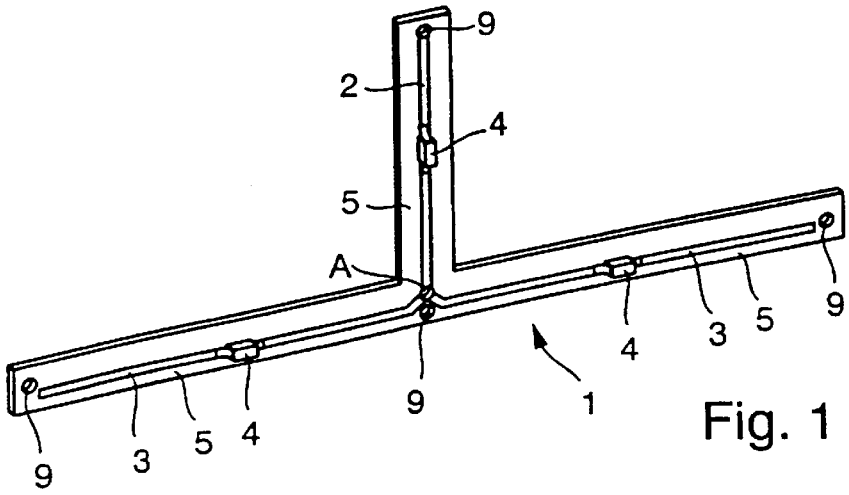
FIG. 1 shows a perspective view of the radiator part of the motor vehicle antenna.

The motor vehicle antenna consists of two separate radiator parts 1 with one lattice reflector which is not shown and which is located towards the motor vehicle interior.

Each radiator part 1 consists of a monopole 2 and two matched balancing antennas 3 which are connected to its base point (A) and project orthogonally in opposite directions therefrom, and one LC-blocking element 4 which is connected to the monopole 2 and the balancing antennas 3.

The monopole 2 and balancing antennas 3 are located as printed circuits on a T-shaped circuit board 5 which is lined on one side and to which the LC-blocking elements formed as SMD components are serially connected.

The total length of the monopole 2 and the balancing antennas 3 is matched in each as to the D network frequency range. The LC blocking elements 4 are designed for the E network frequency range and are arranged such that their distance from the base point A of the monopole 2 corresponds roughly to ¼ of the average operating wavelength in this frequency range. Thus a broadband dual band antenna is accomplished which works both in the D and E network frequency range.

Each radiator part 1 is attached to the outwardly pointing side of the ventilation flap 6 which has been produced in a plastic injection molding process. To do this, the flap 6 has one-piece retaining pins 7 with catch projections 8 which penetrate holes 9 of the circuit board 5 with the radiator part 1 mounted and fitted from behind.

Figure 2:
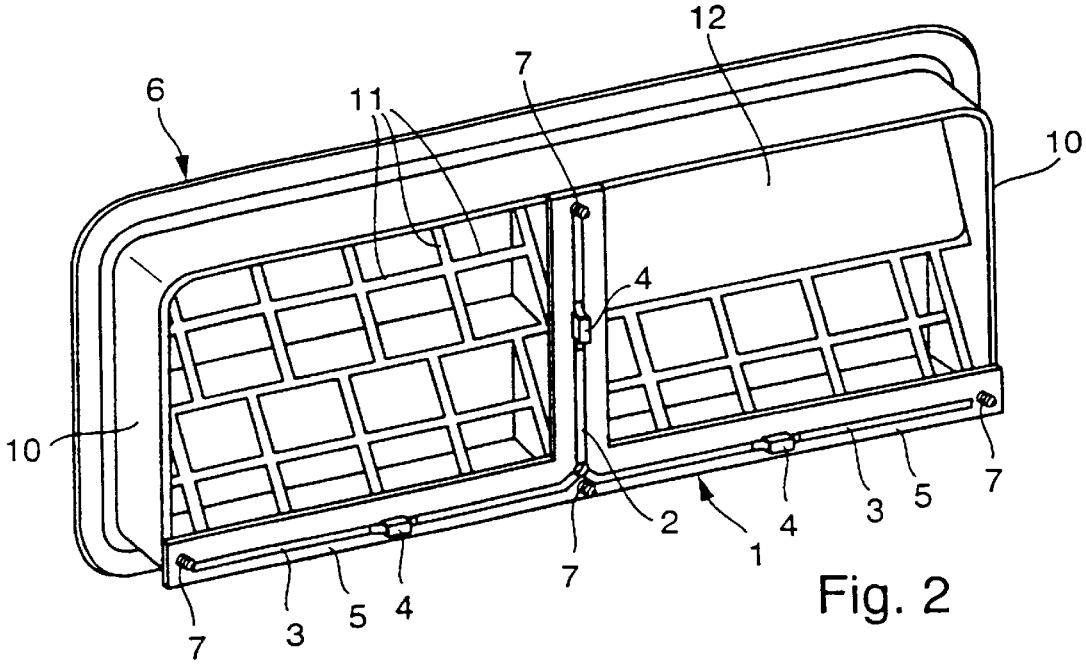
FIG. 2 shows a perspective view of the ventilation flap with the radiator part attached to it.
Figure 3:
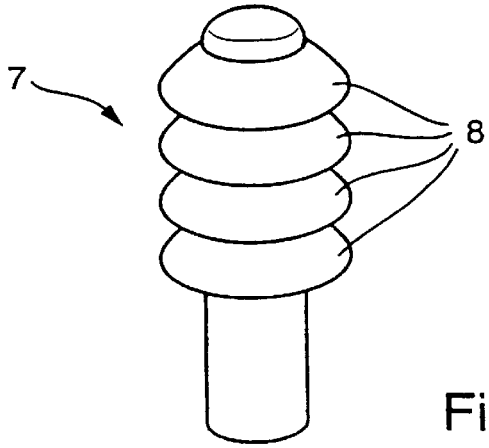
FIG. 3 shows a view of a retaining pin.
Figure 4:
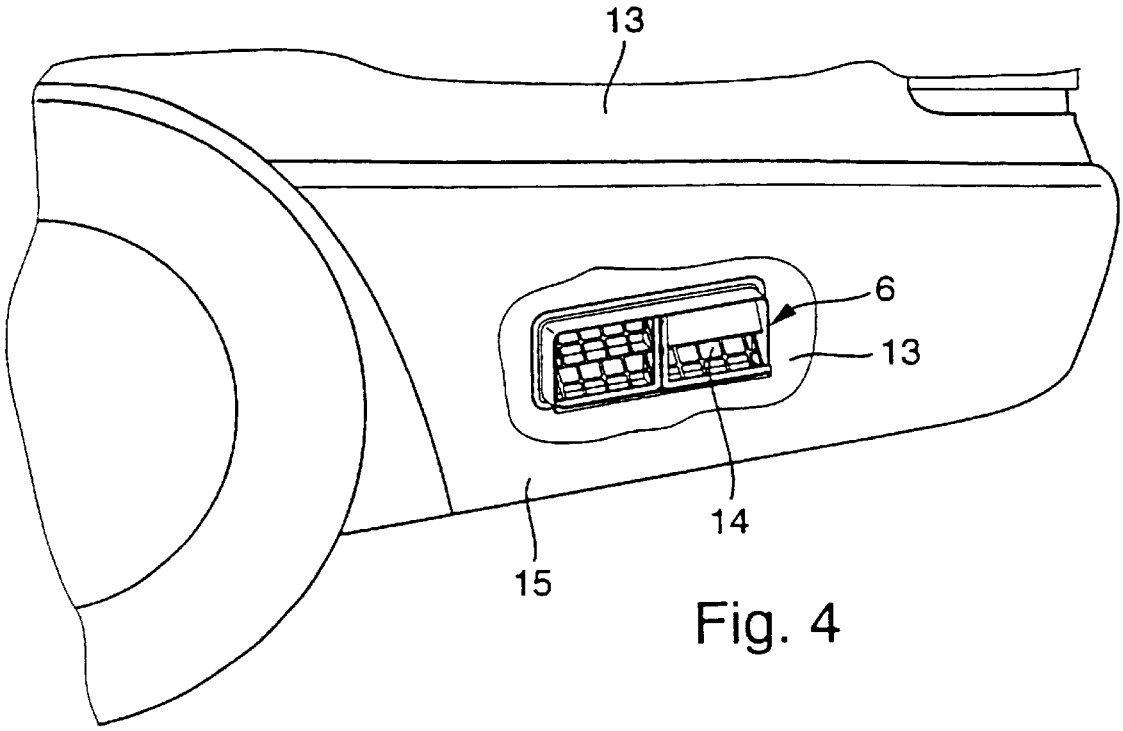
FIG. 4 shows a perspective view of a motor vehicle rear section with a ventilation flap antenna which is visible in an opened part of the bumper.

The vent flaps 6 each have a frame 10 and four sloped lattice surfaces 11, to which one tab 12 at a time is assigned which is attached with the upper lengthwise edge to the frame 10 and which can move around this edge, of which tabs, only one is shown in FIG. 2.

The vent flaps 6 are attached to both sides of the trunk space of the motor vehicle 13 in the body openings 14 (which are covered by the side spurs of the rear bumper 15). For overpressure in the motor vehicle interior (which is formed for example when the motor vehicle door is quickly closed), the pressure is decreased by the air which escapes to the outside from the vent flaps. The tabs 12 are first swivelled to the outside by the overpressure and then after pressure equalization, the tabs 12 again tightly adjoin the lattice surfaces 11 and protect the trunk space from the penetration of splashing water.

The two radiator parts 1 (probes) are (in the manner known from DE 41 16 232 A1) interconnected via feed lines and a line coupler and supplied via a connecting cable to a transmitter-receiver for the mobile radio ranges of the D and E network.

What is claimed is:

1. A motor vehicle antenna comprising:

at least one radiator disposed in a body opening of a motor vehicle;

said radiator including a monopole and a balancing antenna with a length of said monopole and a length of said balancing antenna being matched to a network frequency range; and a nontransparent and nonconductive attachment part disposed to cover said radiator and the body opening of the motor vehicle.

2. The motor vehicle antenna of claim 1, wherein said attachment part comprises a plastic bumper.

3. The motor vehicle antenna of claim 1, wherein said attachment part comprises an antibumping strip.

4. The motor vehicle antenna of claim 1, wherein the body opening being generally rectangular with a dimension in the radiator direction being >⅙ of an average wavelength ($\lambda$) and being $>\lambda/3$ in a dimension orthogonal to the radiator direction.

5. The motor vehicle antenna of claim 1, wherein the radiator and body opening are configured as a slot antenna.

6. The motor vehicle antenna of claim 1, further comprising a reflector, said reflector being disposed towards an interior of said motor vehicle relative to said radiator.

7. The motor vehicle antenna of claim 6, wherein said reflector comprises a lattice configuration.

8. The motor vehicle antenna of claim 1, further comprising a second radiator interconnected with said first radiator.

9. The motor vehicle antenna of claim 8, wherein said radiators are disposed lengthwise on opposite sides of said motor vehicle.

10. The motor vehicle antenna of claim 1, wherein at least one blocking element is positioned with respect to said radiator to provide an upper frequency range such that a length between the blocking element and an antenna termination point (A) is matched to the upper frequency range, and a lower frequency range is provided by a length of said monopole.

11. The motor vehicle antenna of claim 10, wherein said blocking element comprises an LC element.

12. The motor vehicle antenna of claim 10, wherein said radiator includes at least one balancing antenna which is dimensioned for the lower frequency range, and wherein said at least one balancing antenna has at least one blocking element.

13. The motor vehicle antenna of claim 1, wherein said radiator comprises printed circuits on a circuit board.

14. The motor vehicle antenna of claim 1, wherein said monopole and said matched balancing antenna comprises printed circuits on a circuit board.

15. The motor vehicle antenna of claim 10, wherein said at least one blocking element comprises SMD components inserted on a circuit board.

16. The motor vehicle antenna of claim 13, wherein said circuit board is surrounded with insulating material.

17. The motor vehicle antenna of claim 16, wherein said insulating material comprises hot-melt cement.

18. The motor vehicle antenna of claim 13, wherein said circuit board is attached to a nonconductive carrier part housing.

19. The motor vehicle antenna of claim 1, wherein said radiator is disposed in a ventilation opening of the motor vehicle body.

20. The motor vehicle antenna of claim 19, further comprising a nonconductive carrier part in which said radiator is housed, wherein said carrier part comprises a ventilation flap of the motor vehicle.

21. The motor vehicle antenna of claim 1, further comprising retaining pins having catch projections configured to pass through and behind recesses defined on a circuit board having printed circuits comprising said radiator.

22. The motor vehicle antenna of claim 21, wherein said retaining pins are made integral with a nonconductive carrier part in which said radiator is housed.

23. The motor vehicle antenna of claim 22, wherein said carrier part and said retaining pins comprise an injection molding.

24. The motor vehicle antenna of claim 1, wherein said radiator has a roof capacitance.

25. A method for mounting an antenna on a motor vehicle comprising:

positioning at least one radiator in a body opening of the motor vehicle with said radiator including a monopole and a balancing antenna with a length of said monopole and a length of said balancing antenna being matched to a network frequency range; and providing a nontransparent and nonconductive attachment part disposed to cover said radiator and the body opening of the motor vehicle.

26. A motor vehicle antenna comprising:

at least one radiator disposed in a body opening of a motor vehicle;

a nontransparent and nonconductive attachment part disposed to cover said radiator and the body opening of the motor vehicle; and, a reflector, said reflector being disposed towards an interior of said motor vehicle relative to said radiator, and said reflector having a lattice configuration.

27. A motor vehicle antenna comprising:

at least one radiator disposed in a body opening of a motor vehicle;

a nontransparent and nonconductive attachment part disposed to cover said radiator and the body opening of the motor vehicle; and a second radiator interconnected with said first radiator, and both of said radiators disposed lengthwise on opposite sides of said motor vehicle.

28. A motor vehicle antenna comprising:

at least one radiator disposed in a body opening of a motor vehicle;

a nontransparent and nonconductive attachment part disposed to cover said radiator and the body opening of the motor vehicle, wherein said radiator is disposed in a ventilation opening of the motor vehicle body.

29. The motor vehicle antenna of claim 28, further comprising a nonconductive carrier part in which said radiator is housed, wherein said carrier part comprises a ventilation flap of the motor vehicle.

* * * * *